US008220160B2

(12) United States Patent
Davis et al.

(10) Patent No.: US 8,220,160 B2
(45) Date of Patent: Jul. 17, 2012

(54) BOX CUTTER WITH GRIP-ACTUATED BLADE EXTENSION

(75) Inventors: Raymond E. Davis, Heath, TX (US); Clifton G. Hampton, Burleson, TX (US)

(73) Assignee: ADCO Industries-Technologies, L.P., Dallas, TX (US)

( * ) Notice: Subject to any disclaimer, the term of this patent is extended or adjusted under 35 U.S.C. 154(b) by 1394 days.

(21) Appl. No.: 11/735,997

(22) Filed: Apr. 16, 2007

(65) Prior Publication Data

US 2007/0209209 A1 Sep. 13, 2007

(51) Int. Cl.
*B26B 1/08* (2006.01)

(52) U.S. Cl. ..... 30/162; 30/335

(58) Field of Classification Search ..... 30/2, 162, 30/125, 151, 329–340, 293, 294
See application file for complete search history.

(56) References Cited

U.S. PATENT DOCUMENTS

| | | | |
|---|---|---|---|
| 2,018,149 | A | 10/1935 | Randle et al. |
| 3,439,419 | A | 4/1969 | Fleming |
| 4,139,939 | A | 2/1979 | Crooks |
| 4,419,794 | A | 12/1983 | Horton et al. |
| 4,531,286 | A | 7/1985 | Vito et al. |
| 4,683,656 | A | 8/1987 | Peyrot et al. |
| 4,713,885 | A | 12/1987 | Keklak et al. |
| 4,718,586 | A | 1/1988 | Hagino |
| 4,757,612 | A | 7/1988 | Peyrot |
| 4,769,912 | A | 9/1988 | Davis |
| 4,868,985 | A | 9/1989 | Rehm |
| 4,949,458 | A | 8/1990 | Davis et al. |
| 5,012,581 | A | 5/1991 | Fletcher et al. |
| 5,054,170 | A | 10/1991 | Otrusina |
| 5,203,085 | A | 4/1993 | Berns |
| 5,303,474 | A | 4/1994 | Keklak et al. |
| 5,426,855 | A | 6/1995 | Keklak et al. |
| 5,481,804 | A | 1/1996 | Platts |
| 5,511,311 | A | 4/1996 | Collins |

(Continued)

FOREIGN PATENT DOCUMENTS

| | | |
|---|---|---|
| DE | 8704973 | 7/1987 |

(Continued)

OTHER PUBLICATIONS

Partial European Search Report issued in corresponding European Application No. 08153448.9 on Jun. 16, 2008; 4 pages.

(Continued)

*Primary Examiner* — Phong Nguyen
(74) *Attorney, Agent, or Firm* — Fish & Richardson P.C.

(57) ABSTRACT

A utility knife includes a handle body having sidewall portions defining a guide channel, a blade shuttle mounted for extension and retraction movement within the guide channel, and a hand-grip lever coupled to the handle body at a fulcrum for pivotal movement between an at-rest position in which the blade shuttle is in a non-use position, to an in-use position in which the blade shuttle is in an extended position. In the non-use position, a blade mounted on the blade shuttle is enclosed in the guide channel. In the extended position, a portion of the blade projects from the guide channel. The hand-grip lever is rotatably coupled to the blade shuttle through a transmission comprising a pin coupled to the lever such that a distance from the fulcrum to the pin stays substantially fixed as the lever pivots between the at-rest and in-use positions.

31 Claims, 16 Drawing Sheets

U.S. PATENT DOCUMENTS

| | | | |
|---|---|---|---|
| 5,620,120 | A | 4/1997 | Tien |
| 5,730,342 | A | 3/1998 | Tien |
| 5,839,173 | A | 11/1998 | Otrusina |
| D401,832 | S | 12/1998 | Keklak et al. |
| 5,890,294 | A | 4/1999 | Keklak et al. |
| 5,924,203 | A | 7/1999 | Huang |
| 6,000,590 | A | 12/1999 | Allen |
| 6,105,838 | A | 8/2000 | Hansen |
| 6,192,589 | B1 | 2/2001 | Martone et al. |
| 6,364,182 | B1 | 4/2002 | Hansen |
| 6,382,481 | B1 | 5/2002 | McIlmoil |
| 6,427,374 | B1 | 8/2002 | Vaiani |
| 6,553,673 | B2 | 4/2003 | Peyrot et al. |
| 6,578,745 | B1 | 6/2003 | Taylor et al. |
| 6,742,261 | B2 | 6/2004 | Ho |
| 6,752,299 | B2 | 6/2004 | Shetler et al. |
| 6,775,911 | B2 | 8/2004 | Tremblay |
| 6,785,966 | B2 | 9/2004 | Berns |
| 6,813,833 | B2 | 11/2004 | Saunders et al. |
| 6,817,499 | B2 | 11/2004 | Martinez |
| 6,889,879 | B2 | 5/2005 | Rivera et al. |
| 6,966,519 | B2 | 11/2005 | Salentine et al. |
| 7,032,791 | B2 | 4/2006 | Stotts |
| 7,082,688 | B2 * | 8/2006 | Votolato ..... 30/293 |
| 2002/0124418 | A1 | 9/2002 | Votolato |
| 2003/0042348 | A1 | 3/2003 | Salentine et al. |
| 2003/0106917 | A1 | 6/2003 | Shetler et al. |
| 2003/0141329 | A1 | 7/2003 | Huang |
| 2003/0154606 | A1 | 8/2003 | Saunders et al. |
| 2003/0213823 | A1 | 11/2003 | Papovitch |
| 2004/0173650 | A1 | 9/2004 | Berns |
| 2004/0237312 | A1 | 12/2004 | Hernandez et al. |
| 2005/0072819 | A1 | 4/2005 | Maldonado et al. |

FOREIGN PATENT DOCUMENTS

| | | |
|---|---|---|
| DE | 20210670 | 9/2002 |
| FR | 2552008 | 3/1985 |

OTHER PUBLICATIONS

European Search Report issued in corresponding European Application No. 08153448.9 on Sep. 19, 2008; 9 pages.

* cited by examiner

BOX CUTTER WITH GRIP-ACTUATED BLADE EXTENSION

BACKGROUND OF THE INVENTION (1) Field of the invention

This invention relates generally to utility knives, and in particular to hand-held box cutters of the type used in various trades and crafts to cut sheet material and to open cardboard boxes.

(2) Description of the Related Art

Utility knives, commonly known as box cutters, include a handle in which a blade is secured for cutting a variety of materials. Adjustable-blade utility knives in which a replaceable, single-edge blade having a very sharp cutting edge is slideably-retained within a handle assembly have found widespread use in a variety of industries, for a variety of tasks, for example, shipping-and-receiving, drywall construction, wallpapering and tile-laying. Tradesmen use such utility knives to cut paper stock, plastic sheeting, linoleum, carpets, thin wood panels, wall paper, banding straps, tape and sealed plastic sacks containing bulk materials. Stocking clerks use box cutters to open cardboard cartons, for example in grocery stores, supermarkets, convenience stores, restaurants and other retail establishments.

Of special interest are sealed containers and boxes constructed of paperboard, usually corrugated cardboard, in which individually packaged items are shipped. Typically, cardboard containers are taped or glued shut. When a cardboard container is to be opened, a slicing movement is made by pulling the knife rapidly across the top or side of the container to obtain a clean, straight cut. Sharp blades are required for efficient opening of cartons, and a very sharp single-edged razor blade is commonly used for that purpose. This simple task has resulted in many on-the-job personal injuries.

A cardboard carton is generally held steady in front of the operator with one hand and is cut by pulling the knife with the other hand toward the operator across the top or sidewall of the carton. Because such use frequently involves quick hand movements, and the cardboard presents considerable resistance to cutting, hand and wrist muscle fatigue become a serious concern. Moreover, operator flesh wounds are likely when the knife blade travels free at the end of a cut and catches the operator's hand, fingers, arm, waist or leg. Consequently, special attention must be given to box cutter design features that will protect the operator who must work quickly and repetitively.

Boxes containing goods, such as canned goods, bottles, or other boxed grocery items, are often cut along a top edge around the perimeter of the box to remove a top portion of the box, or around an end edge to remove an end portion, exposing the items therein. It is preferable to cut open the box without cutting the contents within the box. It may be difficult, undesirable, and impermissible to sell merchandise that has been cut while opening the shipping box. For these reasons, it is preferable to make an accurate cut along the top edge of the box that avoids cutting the contents therein by cutting above the contents. On the other hand, persons opening boxes and stocking shelves are often under time constraints and economic constraints regarding the time and cost consumed in stocking the shelves. There is also a comfort factor to consider because a grocery stock clerk, for example, may make hundreds of cuts per day. Therefore, a box cutter needs to be easy to use repeatedly over long periods of time, without impairing operator performance or safety because of muscle fatigue.

Another area of concern is blade access and retention. In conventional box cutter knives, a replacement blade is retained by a keeper plate that is confined in a lower groove and an upper groove formed in the handle. The blade is removed from the knife by extending the keeper plate and blade assembly all the way forward out of the knife, which permits the blade to separate from its engagement with the keeper plate. In some cases, especially when the keeper plate is extended completely forward with some force, the blade will simply fall from the handle by its own weight, resulting in a dropped blade. Thus, improved blade retention means needs to be provided for retaining the blade safely within the handle until such time as access is needed for blade replacement, so that the blade may be manually and safely removed by the operator.

An edge guide on a box cutter provides a number of useful advantages. An edge guide allows an operator to quickly and accurately make a cut at a fixed distance from an edge. A guide allows the operator to repeatedly make cuts at a certain angle. A guide allows the operator to make more consistent cuts. An edge guide also allows the operator to make a cut with less effort and less energy exerted. For example, it is usually easier to make a cut with a pulling motion when the user can lean on the guide while pulling, as the guide slides across an edge. Also, the guide allows the operator to make a cut at a precise location with less effort to maintain a stable position of the blade relative to the edge while cutting. Therefore, the use of an edge guide may allow the operator to make the same number of cuts per day more consistently while using less effort and energy, thereby reducing muscle fatigue.

Conventional edge guides provide ways to accurately and quickly cut along an edge of a box at a certain distance from the edge and at a certain angle. However, box cutters are not only used to make edge cuts, but are also often used for other types of cuts, such as cutting a taped edge, where the fixed guard may interfere with or preclude other types of cuts. Also, some edge guards do not provide safety features that will adequately protect a user during repeated rapid cuts. Thus, a need exists for a utility knife configured for reducing repetitive motion injuries caused by hand and wrist muscle fatigue and thumb manipulation to extend the blade, that will enable the operator to repeatedly, accurately and quickly cut open boxes without cutting the contents therein and without compromising the safety of the operator.

Yet another area of concern in box cutter design is blade extension and retraction, which require a high level of manual dexterity, hand coordination and hand strength. Safety and ease of use have been improved by automatic blade retraction. A conventional box-cutter knife with automatic blade retraction has a housing forming a hand grip handle, a blade holder slidable in the housing, and a blade carried in the holder between a front position in which the blade projects forward from the front end of the housing and a retracted position in which the blade is enclosed within the housing. A spring is provided that continuously urges the blade and holder into the rear position. A thumb button is provided which allows the user to push the blade out and hold it extended for cutting action.

When the thumb button is released, the spring automatically urges the blade in retraction back into the housing. Such a knife is considered safe, since the blade will retract automatically except when the thumb button is extended. However, this arrangement is inconvenient as the operator must maintain pressure on the thumb button to use the knife, which causes muscle fatigue after repetitive use, and prevents the thumb from being used to maneuver the knife and establish a firm grip, resulting in a reduction of stability and control during heavy cutting jobs.

BRIEF SUMMARY OF THE INVENTION

An automatic blade-retracting box cutter utility knife of the present invention has a handle with ergonomic hand grip proportions for comfortable gripping and handling during repetitive cutting operations. The principal components of the knife that require operator access are mounted on the handle at locations that are symmetrically disposed relative to the cutting plane of the working blade.

A blade-actuating hand-grip lever is mounted on the handle for movement about a pivotal axis. A blade shuttle is coupled to the hand-grip lever and is received in a guide channel formed in the handle for carrying a working blade from a rear retracted end position in which a working blade is wholly received in the handle, to a front extended end position in which a working blade is extended forward from the handle. The blade shuttle is extended in response to squeezing or gripping actuation of the hand-grip lever, and automatically retracts when the hand-grip lever is released.

Extension and retraction forces are transferred from the hand-grip lever to a compression spring and to the blade shuttle via a power transmission assembly that includes a torque plate that is mounted for clockwise and counterclockwise rotation on the handle. The energy provided by hand-grip actuation is stored in a compression spring that is coupled between the handle and the hand-grip lever. The blade shuttle is retracted in response to expansion of the compression spring when the hand-grip lever is released.

A depth of cut adjustment assembly is integrated with the power transmission assembly. Depth of cut, or blade extension, is selectively set to a desired depth of cut by manual adjustment of a rotary dial, which limits pivoting travel of the gripping lever during hand grip actuation.

Top access to a working blade and a replacement blade stored on the shuttle is provided on top of the handle for blade loading and security. The working blade and one or more replacement blades are securely retained in top loading compartments formed between the sidewalls of the blade shuttle. A window formed in the top of the handle provides operator access for loading and replacing blades. The window is closed by a blade cover that is pivotally attached to the handle, thereby providing a protective covering over the blade receiving compartment in a closed position, and providing operator access to the blade receiving compartment in an open position.

The handle has a blade extension port that is wedge-shaped in profile, being narrow at the top and relatively wide at the bottom. During a cutting operation, the working blade is locked against deflection on both sides and along the top and bottom of the blade. This prevents buckling of the blade as the cutter blade is undergoing heavy cutting action.

Dual edge guide members are mounted for independent extension and retraction movement, enabling use by left handed as well as right-handed operators.

A fixed blade stub projects from the rear of the housing for quick tape cutting jobs. The exposed cutting edges and corners are relatively blunt for personal safety and product protection. The fixed blade stub is mounted on the butt end of the handle and can be used while the cutting blade is locked in the fully retracted position, thus improving operator safety when using the knife to perform tape cutting operations that do not require a sharp cutting edge.

BRIEF DESCRIPTION OF THE DRAWING FIGURES

The accompanying drawing is incorporated into and forms a part of the specification to illustrate the preferred embodiments of the present invention. Various advantages and features of the invention will be understood from the following detailed description taken with reference to the attached drawing figures in which.

DETAILED DESCRIPTION OF PREFERRED EMBODIMENTS

Figure 1:
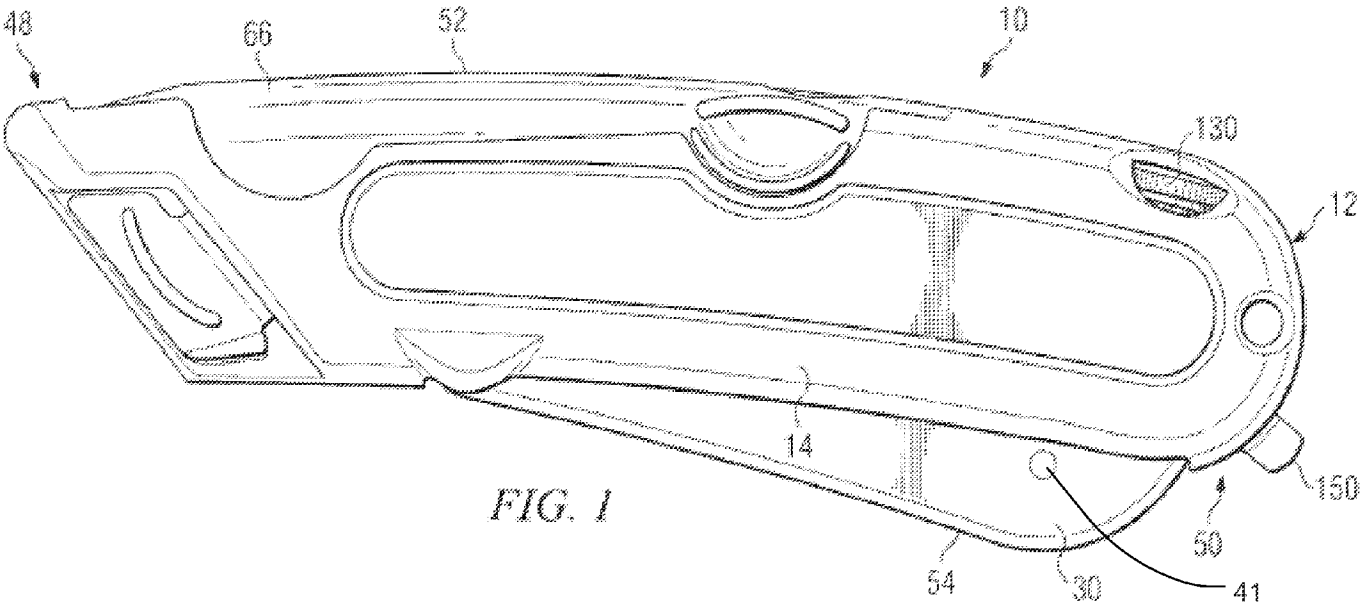
FIG. 1 is a left side elevation view of a box cutter utility knife having an ergonomic handle and equipped with the cutter blade management features of my invention.

Preferred embodiments of the invention will now be described with reference to various examples of how the invention can best be made and used. Like reference numerals are used throughout the description and several views of the drawing to indicate like or corresponding parts. As used herein, "utility knife" and "box cutter" are used interchangeably to refer a hand-held knife of the type used to open cardboard cartons.

Figure 2:
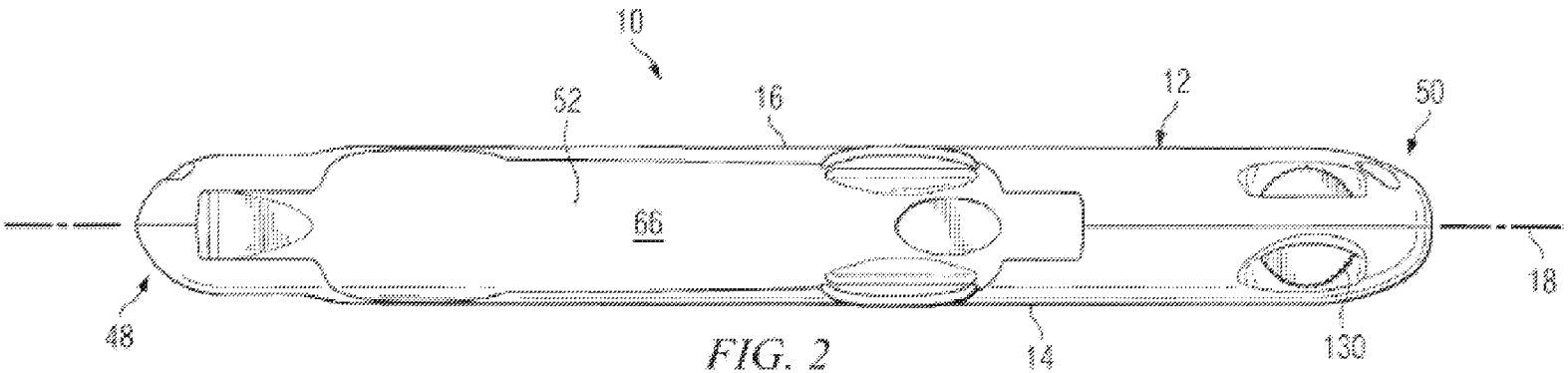
FIG. 2 is a top plan view thereof, showing the cutter blade and edge guides in the retracted position, and blade access cover in the closed position.
Figure 3:
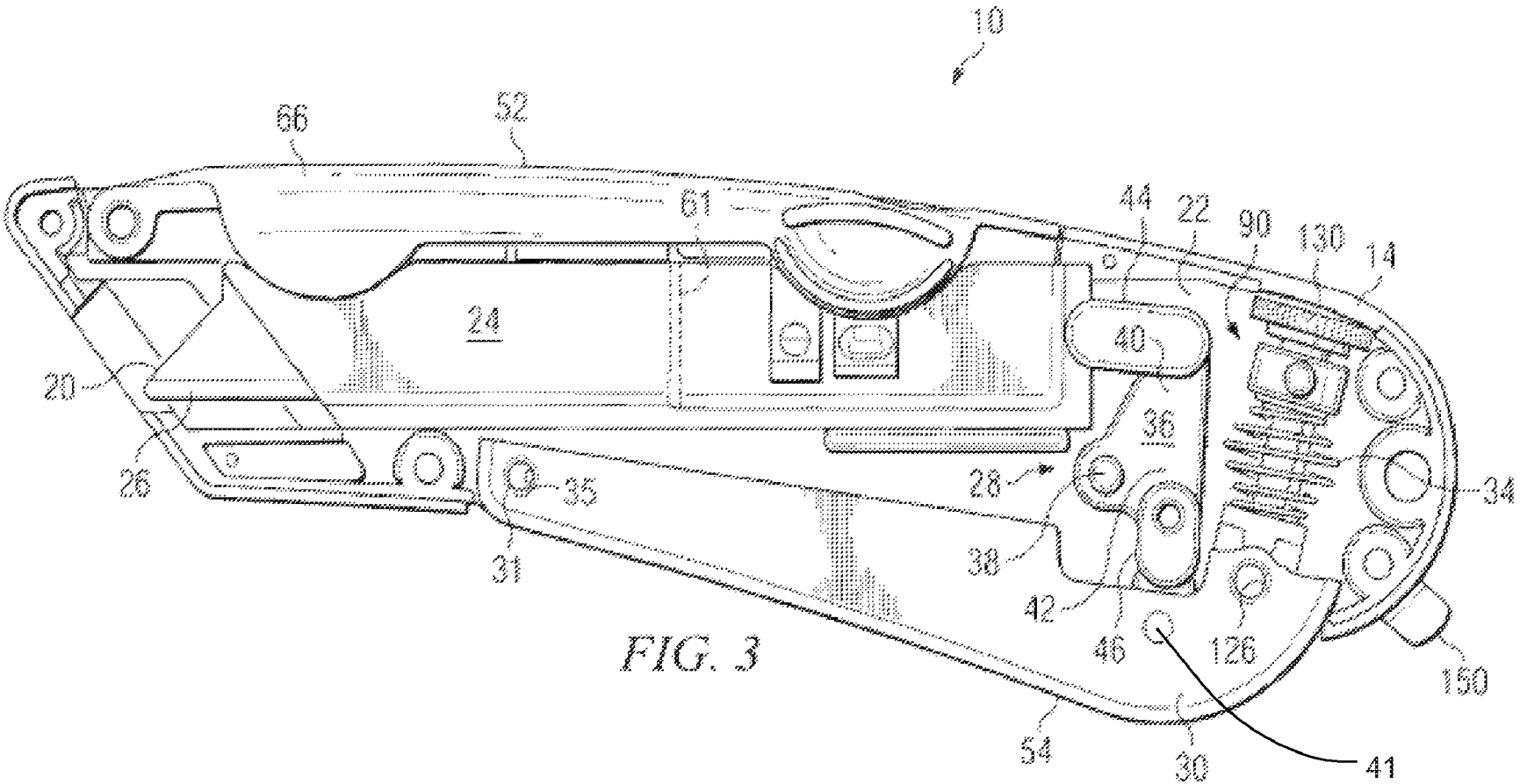
FIG. 3 is a left side elevation view thereof, with the left handle sidewall removed, showing the blade shuttle, power transmission assembly and hand-grip lever in the at-rest, blade retracted position.
Figure 4:
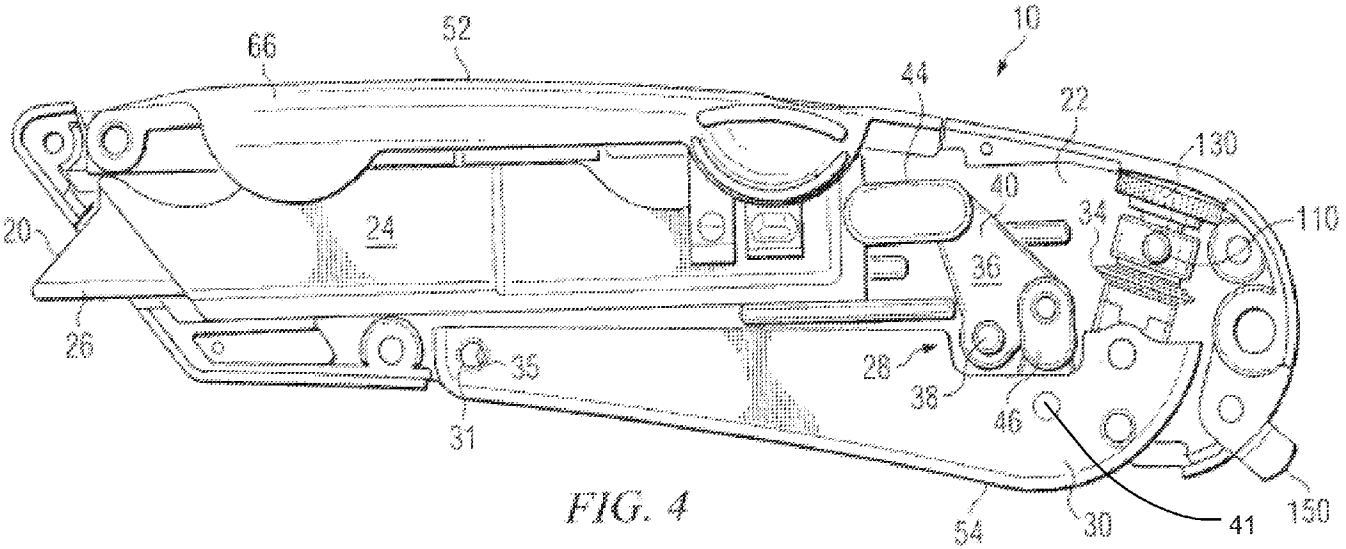
FIG. 4 is a left side elevation view thereof, with the left handle sidewall removed, showing the blade shuttle extended, power transmission assembly and hand-grip lever actuated in the blade exposed position.

Referring now to FIG. 1 and FIG. 2, a box cutter utility knife 10 of the present invention includes a handle 12 formed by a pair of molded plastic handle sections 14 and 16. The handle sections 14, 16 have bilateral symmetry along the cutting plane 18 of the working blade 20 and are connected together to enclose a cavity 22. The working blade 20 is held in a molded plastic blade shuttle 24 that is movable through a guide channel 25 formed along the handle sidewalls in an outward or forward direction to a fully extended position (FIG. 4) and in an opposite inward or rearward direction to a retracted position (FIG. 3). In the intermediate and extended positions, an exposed cutting edge 26 of the working blade can be engaged against a workpiece, for example, for cutting corrugated paperboard.

Unlike conventional box cutters equipped with exposed blades, the working blade 20 of the utility knife 10 is automatically retracted within the handle when the working blade is withdrawn from a cut, so it is less likely to inflict injury during use or when handled casually with the blade extended. The principal components of the utility knife 10 include the handle assembly 12 which covers the cutting edge of the working blade when it is not engaged against a cardboard container or other workpiece, the blade shuttle 24 which fits into the handle assembly 12, the working blade 20 which is retained and carried on the shuttle 24, a spring-loaded power transmission assembly 28 enclosed within the handle, and a hand-grip lever 30 which actuates the power transmission assembly.

The handle sections 14, 16 form a handle body 12 having ergonomic hand grip proportions for comfortable gripping and handling during repetitive cutting operations. The blade-actuating hand-grip lever 30 is pivotally mounted on pivot pins 31, 33 received in sockets 35, 37 formed in the handle sections for movement about a pivotal axis 32. The blade shuttle 24 is mounted for longitudinal sliding reciprocal movement in the handle cavity 22 from a retracted rear end position (FIG. 3) in which the working blade 20 is totally enclosed in the handle, to an extended front end position in which a portion of the working blade 20 projects forward from the handle. The blade shuttle 24 is extended in response to gripping actuation of the hand-grip lever 30 and retracts automatically upon release. The energy provided by hand-grip actuation is stored in a compression spring 34 that is coupled between the handle 12 and the hand-grip lever 30. Preferably, the compression spring 34 has a coil profile in the form of a barrel, with large diameter coil turns centered on opposite sides between small diameter coil turns. The barrel spring 34 permits the assembly to be contained entirely within the handle, since the barrel spring will compress into a minimum dimension pancake stack profile upon full compression. The blade shuttle 24 is retracted by expansion of the compression spring 34 when the hand-grip lever is released.

The handle body 12 has a curved top side 52, a curved underside 54, a butt end portion 50, a blade projection end portion 48, a first handle sidewall 14 and a second handle sidewall 16 forming a guide channel 25 between the handle body end portions, and a blade extension port 70 disposed on the blade projection end portion of the handle body and aligned with the guide channel.

The extension and retraction forces are transferred from the hand-grip lever 30 to the compression spring 34 and to the blade shuttle 24 via the power transmission assembly 28 that includes a torque plate 36 that is mounted on a pivot pin 38 for clockwise and counterclockwise rotation within the handle cavity 22. The torque plate 36 includes a pair of torque transfer arms 40, 42 that are coupled to the blade shuttle 24 and to the hand-grip lever 30 by first and second toggle links 44, 46 (via a pin 41 disposed through the hand-grip lever 30 and toggle link 46), respectively.

According to this arrangement, upon hand-grip actuation, the compression spring 34 is compressed simultaneously as the blade shuttle 24 is extended, and upon release of the hand-grip lever 34, the compression spring 34 expands, urging the hand-grip lever toward its at-rest position (FIG. 3) and returning the blade shuttle 24 to its rear retracted end position.

The torque transfer action and compressed spring reaction of the power transmission assembly 28 ensure that the working blade 20 will be extended and will stay extended so long as the working blade is held against the object being cut. The power transmission assembly provides a mechanical advantage in that only a relatively small amount of hand grip force is needed to compress the spring 34 and maintain extension of the working blade while applying only moderate force against the object being cut, while at the same time, the reaction torque provided by the compression spring 34 is adequate to quickly retract the working blade 20 upon release of the hand-grip lever and disengagement from a work piece.

The handle 12 is formed with ergonomic hand grip proportions. The blade shuttle is disposed generally in coplanar alignment with the working blade cutting plane 18. The power transmission assembly 28 and the torque plate 36 rotate clockwise and counterclockwise, generally in coplanar alignment with the blade shuttle 24 as it moves between the extended and retracted positions, thus reducing the required thickness size of the handle 12. This allows the handle to be gripped firmly and comfortably by an operator having an average size hand.

The hand-grip lever 30 has sufficient length to engage all four fingers of the operator's hand, so that hand-grip actuation forces are distributed substantially uniformly through all hand and finger muscles, thereby reducing muscle fatigue. This ergonomic arrangement also leaves the operator's thumb free to grip the handle sidewall and tightly clamp it against the operator's forefinger, thus holding the knife 10 steady during cutting operations. Moreover, the handle 12 has a generally wedge profile, having a relatively narrow cross section at the front or nose blade extension end portion 48 and relatively wider cross section at the rear or butt end portion 50 of the handle, and slightly curved along the top side 52 and bottom side 54.

The upper and lower curved handle portions conform generally to the natural profile curvature of an operator's grip when the operator's hand and fingers are curled in gripping engagement around the handle 12, and the hand grip lever 30 extending longitudinally along the underside 54 of the handle body thereby allowing independent thumb and forefinger movement and gripping engagement of the handle body between the thumb and forefinger simultaneously with finger gripping engagement about the hand grip lever 30. This configuration conforms generally with the natural wedge-shaped, curved gripping profile provided by the operator's hand, fingers and thumb in the operative, gripping engagement around the handle body.

The knife 10 is provided with top loading blade access and security. Referring now to FIG. 5, FIG. 6, FIG. 7 and FIG. 8, the working blade 20 is securely retained in a pocket or compartment 56 formed between the sidewalls 58, 60 of the blade shuttle 24. The working blade pocket 56 has a working blade loading aperture 62 in which a working blade is inserted and released while the handle is held upright and level, a shown in FIG. 8. The working blade 20 is double-ended and is intersected by an index notch 64 between two cutting edges 26A, 26B. The index notch 64 is engaged with a rib segment on the floor of the working blade pocket, which accurately positions the working blade in the shuttle. The loading aperture 62 is closed and secured by a top panel door 66 that is pivotally coupled to the housing on or near the nose portion 48.

Two replacement cutter blades 21, 23 are securely retained in a replacement blade storage pocket 57 formed between the sidewalls 58, 60 of the blade shuttle 24 and in tandem with the working blade compartment 56. Each blade storage pocket has a top loading aperture through which the blades are inserted and withdrawn. The loading aperture 63 of the replacement blade storage pocket 57 is closed and secured by an interior panel door 59 that is pivotally coupled to the handle.

The interior panel door is pivotally mounted on a central cross web 65 that extends between the handle sidewalls and provides a stable pivotal under-support for the internal storage cover panel door 59. The cross web also reinforces the shuttle sidewalls 58,60 to oppose deflection caused by hand grip pressure.

The interior panel door 59 is covered and enclosed by the main closure panel door 66, which can be opened and closed independently of the interior panel door. The replacement blade storage pocket 57 is separated from the working blade pocket 56 by a central cross rib 61. The cross rib 57 stabilizes the working cutter blade 20 against longitudinal displacement, and reinforces the shuttle sidewalls 58, 60 to oppose deflection caused by hand grip pressure.

The top blade cover panel door 66 provides a protective covering over the blade receiving compartment in the closed position. The top panel door is latched into the closed position by first and second resilient interlocking coupling members 67, 69 formed on the panel door 66 and the handle housing.

Figure 7:
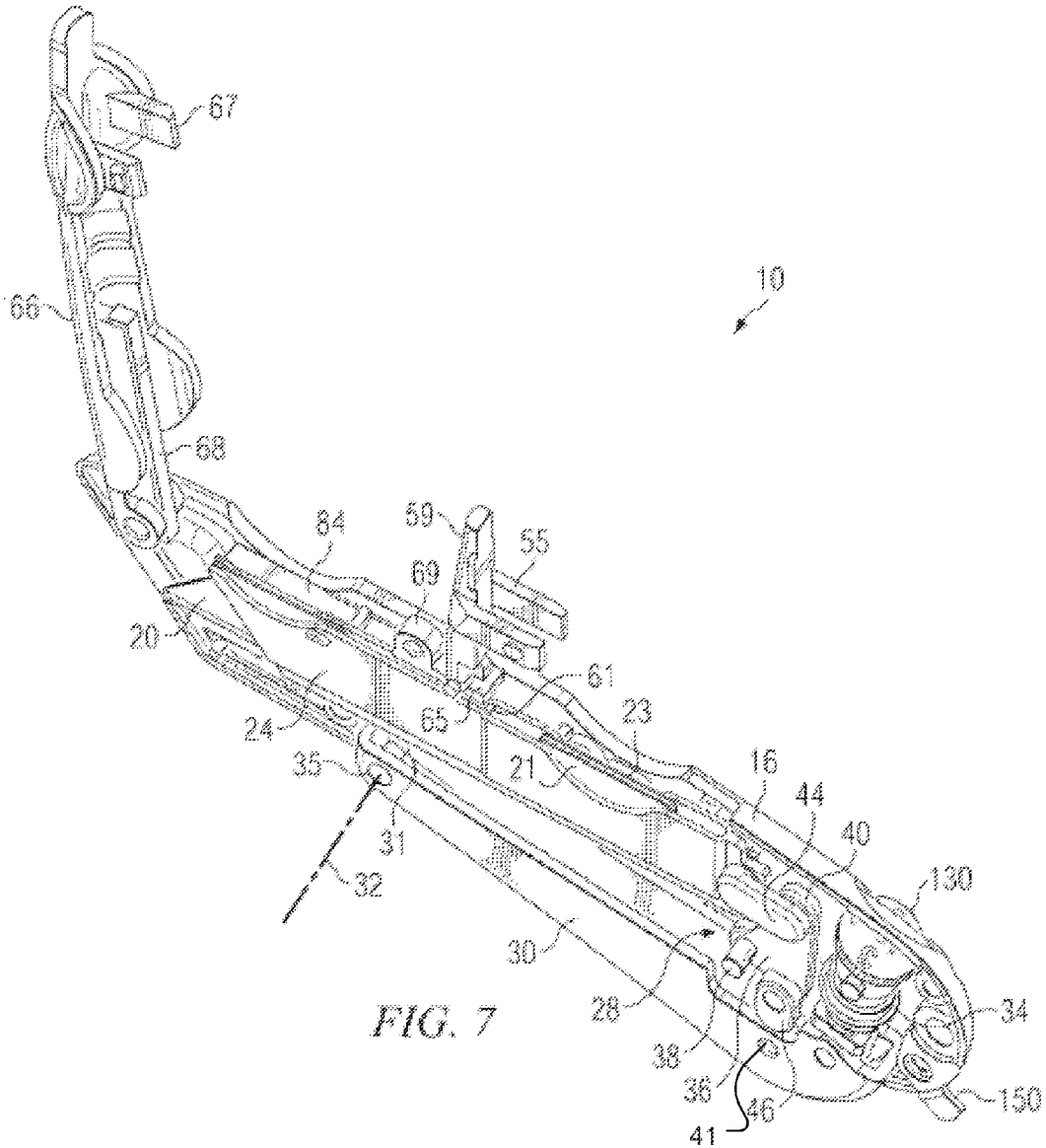
FIG. 7 is an enlarged perspective view similar to FIG. 5 showing details of the blade shuttle, hand-grip lever and power transmission assembly.
Figure 8:
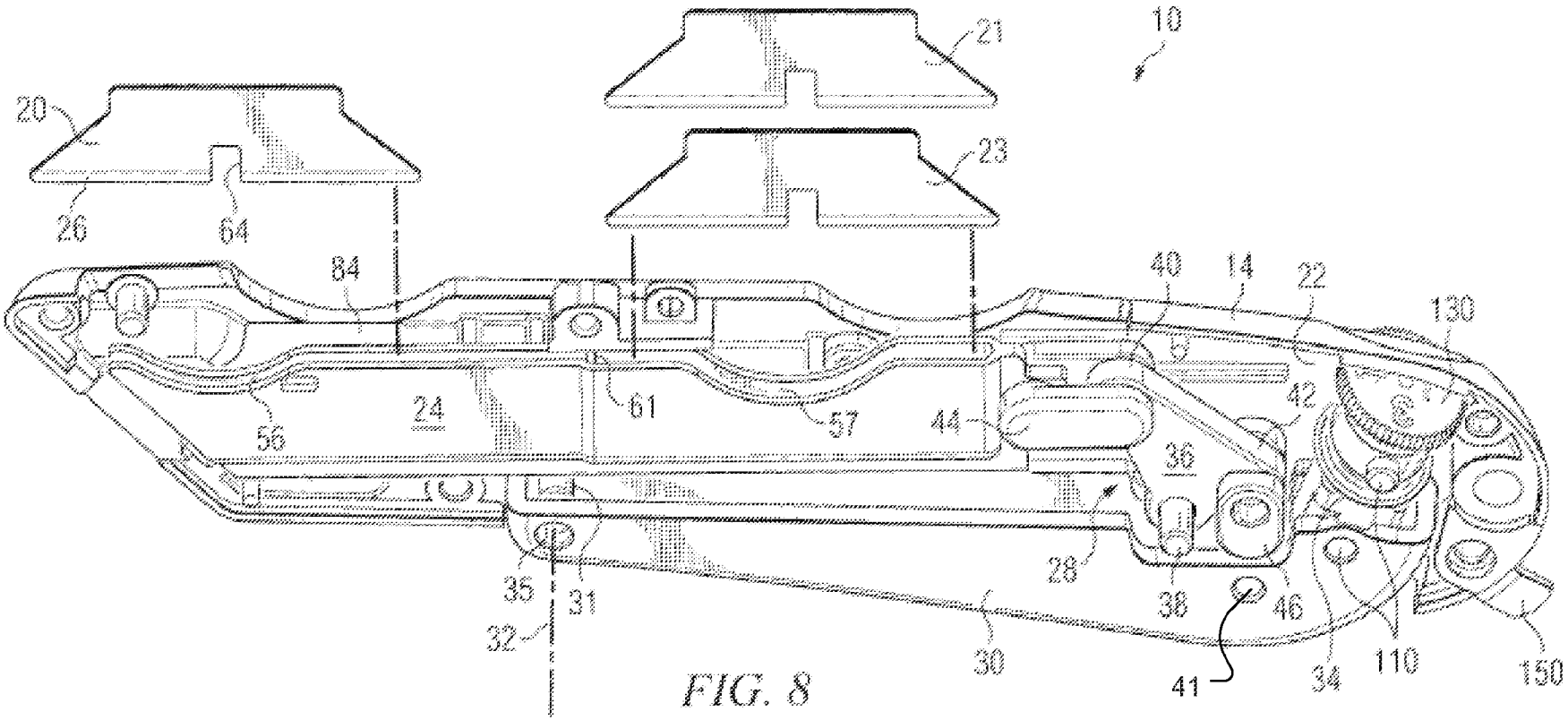
FIG. 8 is an enlarged perspective view similar to FIG. 7, with access door panels removed, showing a working blade and two replacement blades positioned for loading insertion into the blade receiving compartments of the blade shuttle.

The closure panel door 66 is reinforced by a metal reaction plate 68 (FIG. 7). The metal reaction plate 68 is mounted on the underside of the top closure panel door for engaging the top of the working blade 20 when the top panel door is closed, which keeps the working blade confined in the shuttle compartment 56 and forms a hard shield that opposes direct contact by the top of the working blade 20 against the top panel door. The metal shield 68 prevents structural damage to the closure panel door that would otherwise be caused by working blade gouging and cutting of the top panel door 66, which is formed of a durable, high strength plastic material, but which is relatively soft compared to the hardness of with the working blade, which is made of tool steel, approximately 0.017 inch thick (about 0.4318 mm).

Figure 9:
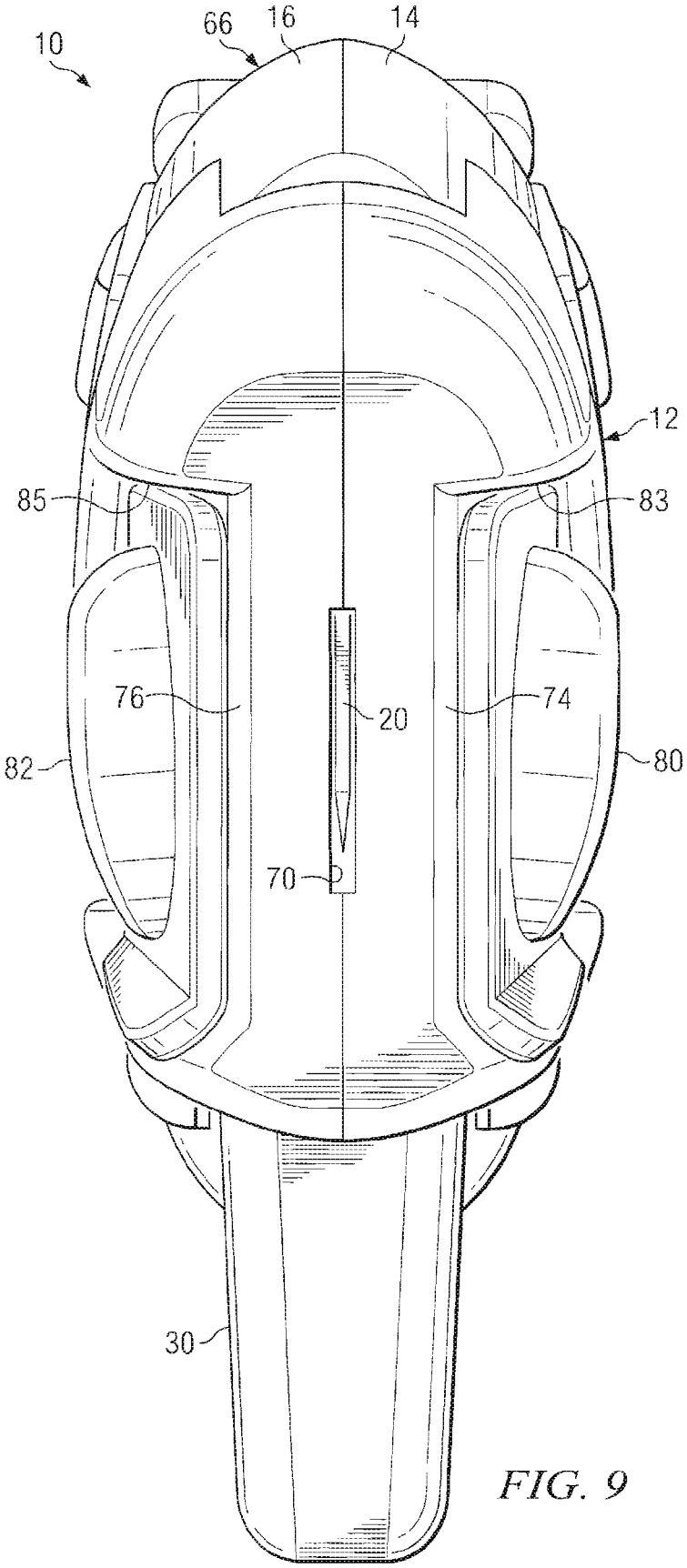
FIG. 9 is an enlarged front elevation view of the box cutter knife of FIG. 1 showing details of the blade extension port.
Figure 10:
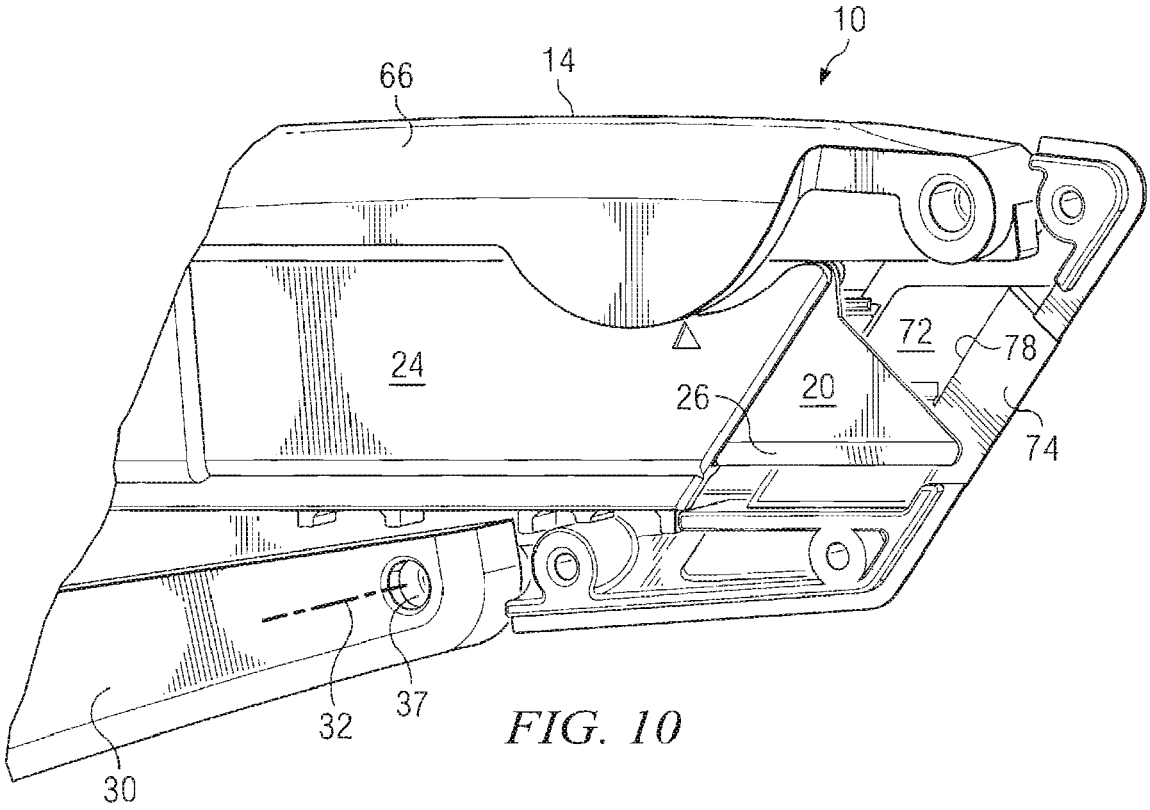
FIG. 10 is an enlarged side elevation of a handle housing, which shows a flared blade guide surface which provides variable side support for a working blade.

Referring now to FIG. 9 and FIG. 10, the handle 12 has a blade extension port or aperture 70 that is rectangular in profile. The blade extension port 70 provides a exit window for a wedge-shaped channel 72 formed by a pair of handle sidewall web portions 74, 76 that are outwardly flared from the blade extension port. The flared web portions provide a blade extension channel that is relatively narrow in lateral cross-section at the extension port 70 and relatively wide in lateral cross-section near the fully retracted position of the blade shuttle 24, at a longitudinal distance of about 0.125 inch inwardly from the front of the handle nose.

Preferably, the handle edge portions defining the front aperture 70 provide a lateral clearance of about 0.0025 inch (about 0.0635 mm) to about 0.0030 inch (about 0.0762 mm) on each side of the working blade at the aperture 70, and the flared side web portions 74, 76 provide a lateral clearance of about 0.0045 inch (0.1143 mm) to about 0.0050 inch (0.127 mm) on each side of the working blade at the terminal end 78 of each flared web portion.

During a cutting operation, the working blade 20 is locked against deflection on both sides and along the top and bottom edges of the blade by the handle edge portions that frame the extension port 70 (FIG. 9). This prevents buckling of the working blade as the blade undergoes heavy cutting action. Resistance during a cutting operation forces the working blade against the metal reaction plate 68, and into a narrow portion of the blade extension channel, to stabilize the blade and limit lateral deflection. The working blade 20 will retract into the enlarged rear area of the blade extension channel 72 where there is greater lateral clearance to accommodate smooth blade extension and retraction.

Figure 6:
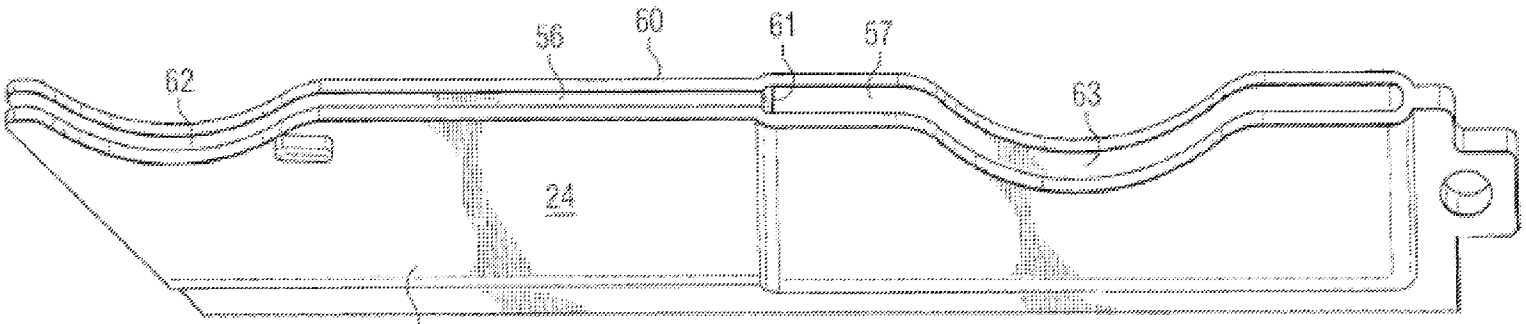
FIG. 6 is a perspective view of a blade shuttle equipped with a top loading working blade compartment and a top loading replacement blade compartment.
Figure 5:
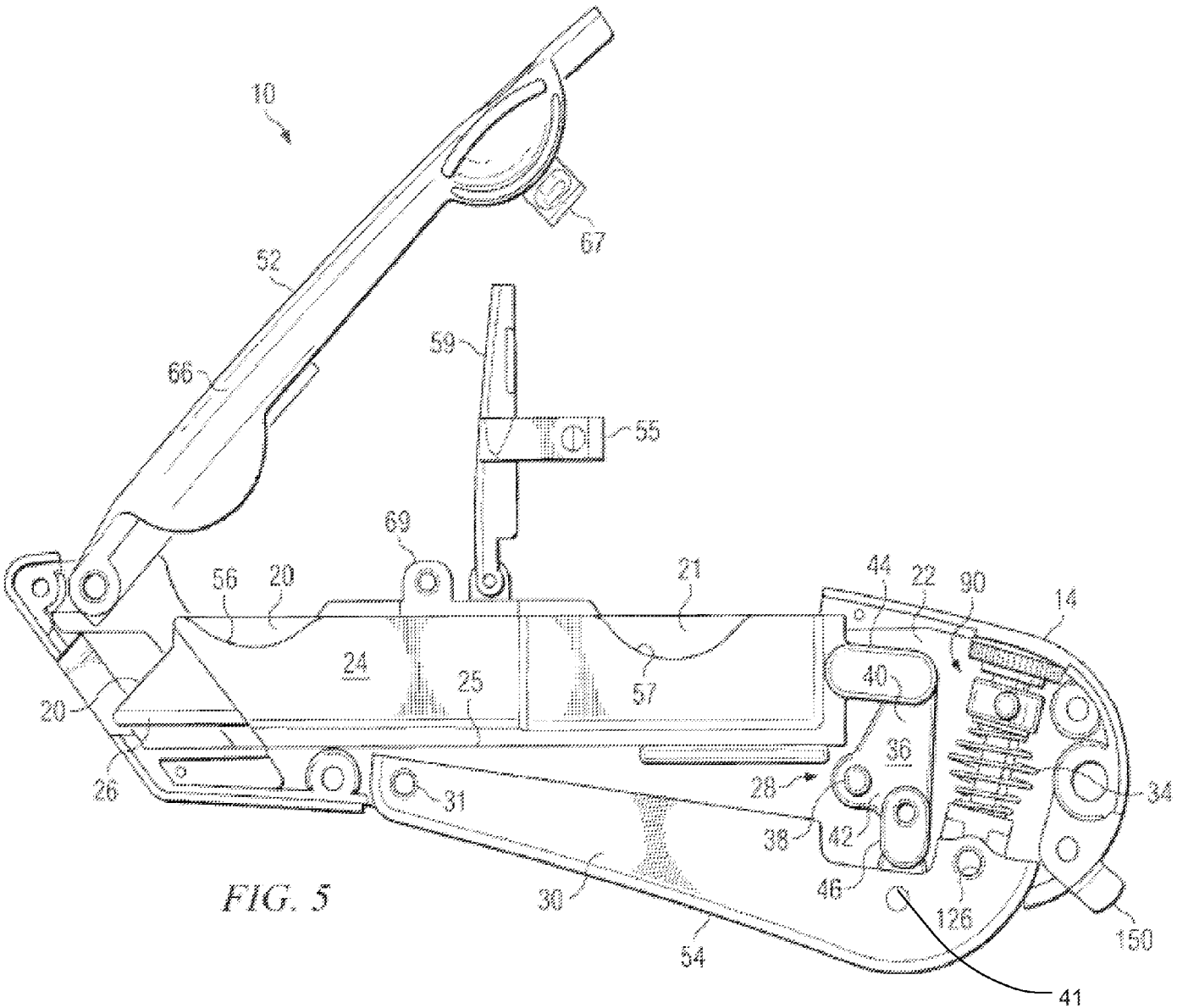
FIG. 5 is a side elevation view similar to FIG. 3, with the working blade access cover panel and replacement blade access cover panel in the unlatched, open access positions.

Referring now to FIG. 6, the blade shuttle 24 carries the working blade 20 and one or more replacement blades 21, 23 in separate compartments 56, 57 that are aligned in tandem relation. The shuttle 24 is made of a durable, resilient plastic material that exhibits the property of shape memory recovery, which enables it to deflect and recover its straight configuration after undergoing compression, bending and torque forces during a cutting operation. The shuttle 24 has a blade pocket, formed by parallel sidewalls and a bottom floor wall. The pocket is open at the top to receive a replacement working blade, and open at the front to allow the working blade to project through the front blade extension port 70, thereby exposing the cutting edge 26 of the working blade 20.

The handle sections 14, 16 are reinforced by a pair of planar web portions 84, 86 that extend from the handle sections on opposite sides of the blade shuttle. The web portions engage slidably against the blade shuttle sidewalls 58, 60. The web portions thereby provide a dust cover for the handle cavity 22 and shuttle compartments 56, 57, reinforce the handle sections against deflection caused by hand grip pressure, and prevent improper insertion of the working blade 20.

Figure 11:
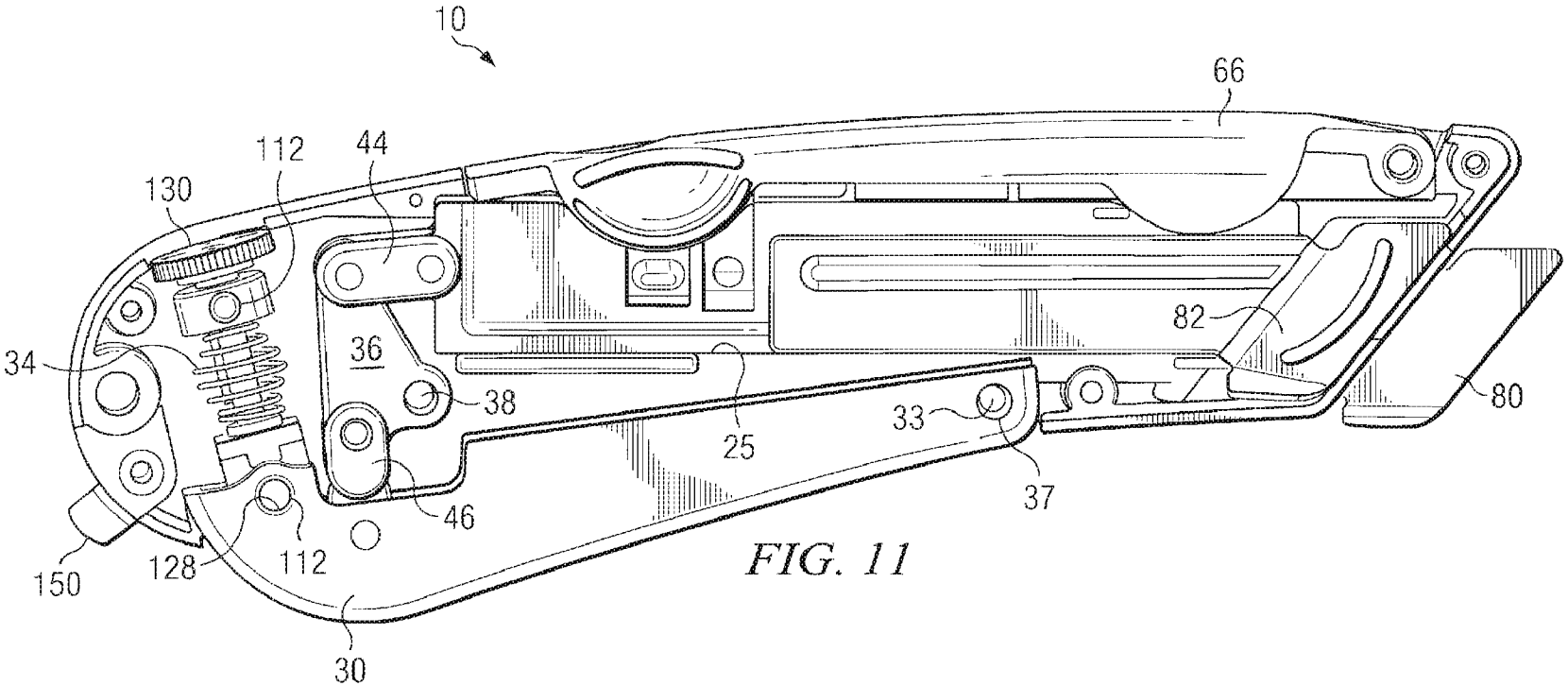
FIG. 11 is a right side elevation view of the box cutter utility knife of FIG. 1, with the right handle sidewall removed, showing the left edge guide extended and the right edge guide fully retracted.

Referring now to FIG. 9 and FIG. 11, dual edge cutting guide members 80, 82 are mounted for independent extension and retraction movement. The edge guide members 80, 82 are symmetrically disposed on laterally opposite sides of the blade extension port 70. This dual edge, symmetrical guide arrangement allows a right-handed or a left-handed operator to quickly and accurately make a cut at a fixed distance from a box edge and at a fixed angle. A first edge guide member is mounted on the right handle sidewall for extension and retraction relative to the blade projection end portion of the handle body, and a second edge guide member is mounted on the left handle sidewall for extension and retraction movement relative to the blade projection end portion of the handle body. Each edge guide member is mounted in inset pockets 83, 85 formed in the handle sidewalls, respectively, as shown in FIG. 9. This symmetrical, inset mounting arrangement provides maximum blade view for left handed as well as right handed operators.

Referring now to FIG. 3 and FIGS. 12-17, a depth of cut adjustment assembly 90 is integrated with the power transmission assembly 28. Depth of cut, or blade extension, is set by limiting pivoting travel of the hand grip lever 30 during hand grip actuation. A spindle guide post 92 is mounted on a travel block bushing 94. The travel block bushing is pivotally coupled to the gripping lever 30 on pivot pins 96, 98. The travel block guide bushing 94 is intersected by a main bore 100 and one or more axially extending index pockets 102, 104, 106 of various depths that correspond to predetermined blade extensions.

The opposite end of the spindle guide post 92 is mounted for rotary clockwise and counter-clockwise movement relative to the handle 12. A coupling collar 108 is pivotally mounted to the handle by radially projecting pivot pins 110, 112 that latch into pockets formed on the handle sidewall sections. The upper end of the guide post is fitted with latching pins 109, 111, 113 that are releasably engagable in detent pockets or slots 114, 116, 118 and 120 formed in the underside of the coupling collar 108. An elongated rib or spline 122 formed on the spindle guide post 92 extends through a bore 109 formed in the guide post for engagement in a selected one of the depth of cut index slots 100, 102, 104. Preferably, the guide post is formed by a steel post enclosed within a jacket of high strength polymer material.

The radially projecting pivot pins 110, 112 of the coupling collar 108 are received within a pair of pockets formed in the handle portions, thus preventing rotation of the coupling collar. The spline 122 is selectively engagable in each index slot 100, 102, 104. Depth of cut adjustment is made by manually rotating the spindle guide post 92 until the spline 122 is brought into registration with the desired depth of cut index slot.

A manually operable depth of adjustment dial 130 is attached to the top of the spindle guide post 92. As the dial is rotated, the barrel spring 34 compresses, allowing the spindle post to turn and the spindle index spline 122 to advance to the next index slot. The dial is intersected by a bore 134 and includes a flat 136 for engaging a mating post 138 and flat 140 formed on top of the guide post 92. Window slots 140, 142 are formed in the housing on opposite sides of the dial 130. The edges of the dial project through the window slots, thereby providing convenient operator access to adjust the dial to a locked position (L), to minimum depth of cut position (No. 1), to a median depth of cut position (No. 2), to a maximum depth of cut position (No. 3).

While most of the thin rectangular blade portion is covered between the two sidewalls of the shuttle, a triangular blade segment projects beyond the oblique margins at the front of the shuttle, thus exposing the cutting edge in this region. The cutting edge is positioned in parallel with the lower longitudinal edge of the shuttle and is offset only slightly above the lower edge of the knife. The exposed portion of the triangular blade segment corresponds with the maximum depth of cut, for example 5/16 inch, at the maximum setting "No. 3."

The depth of cut selection is maintained by the compression spring 34, which is mounted around the spindle guide post. The compression spring urges the coupling collar into engagement with the index spline of the spindle, which is received in detented latching engagement with one of the depth of cut index pockets formed on the travel block 94.

Figure 12:
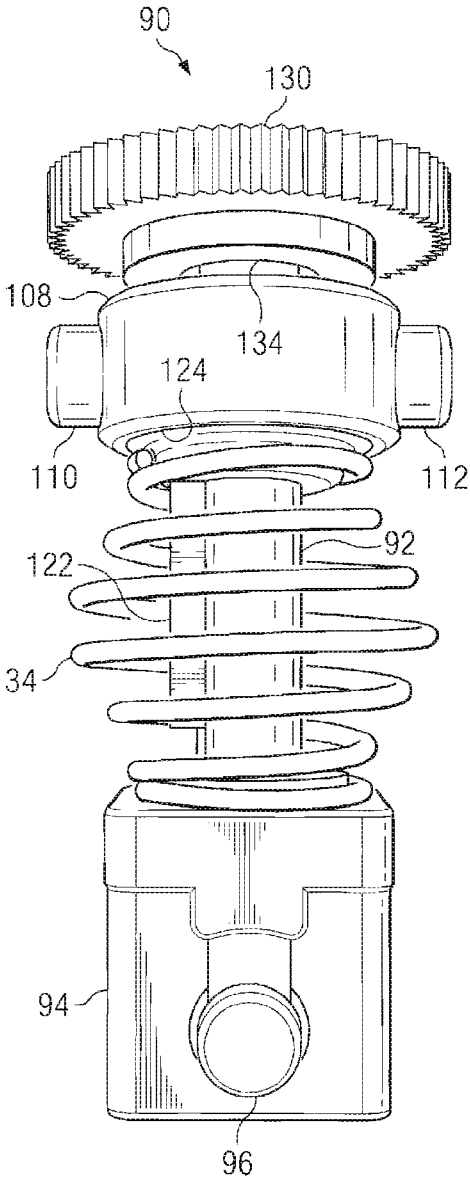
FIG. 12 is an enlarged perspective view of a depth of cut adjustment assembly of my invention.
Figure 13:
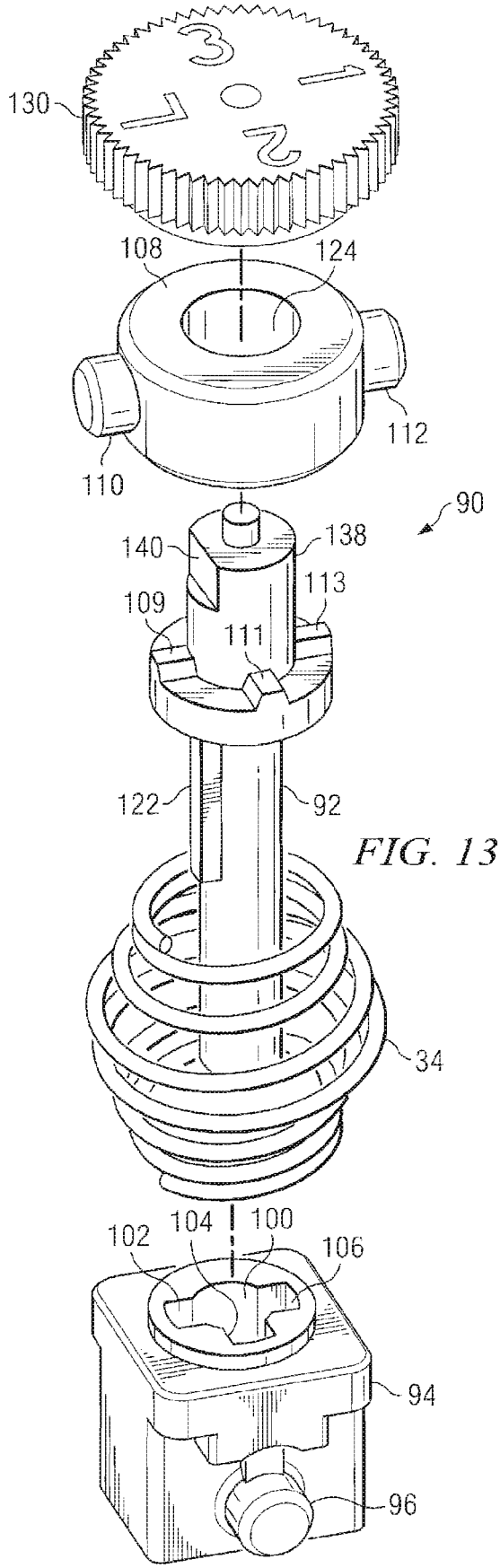
FIG. 13 is an exploded perspective view of the depth of cut adjustment assembly of FIG. 12.
Figure 14:
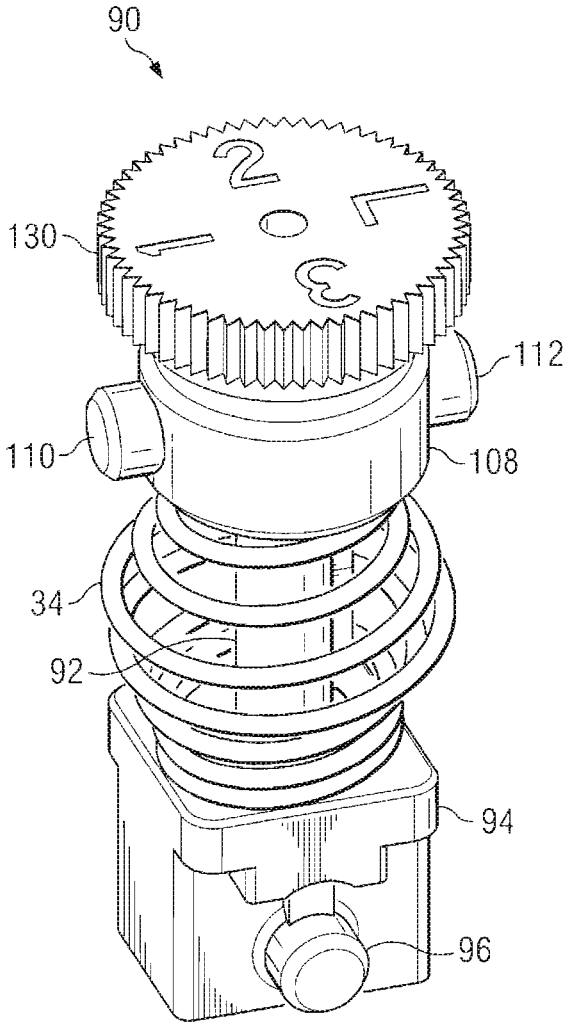
FIG. 14 is a top perspective view of the depth of cut adjustment assembly of FIG. 12.
Figure 15:
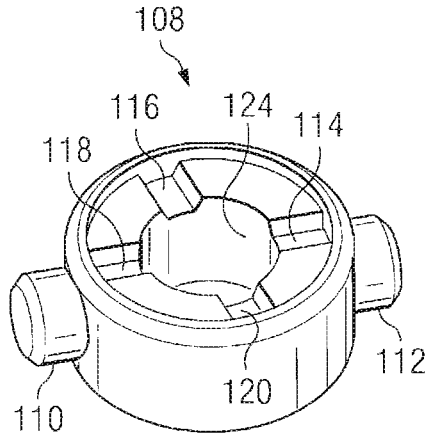
FIG. 15 is an underside perspective view of the index coupling collar shown in FIG. 13.
Figure 16:
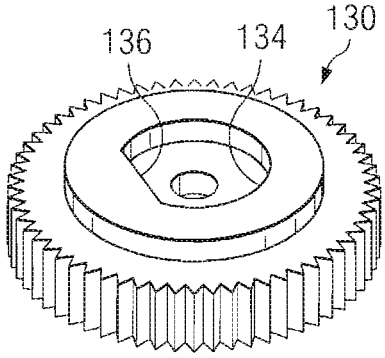
FIG. 16 is an underside perspective view of the rotary depth of cut adjustment dial shown in FIG. 13.
Figure 17:
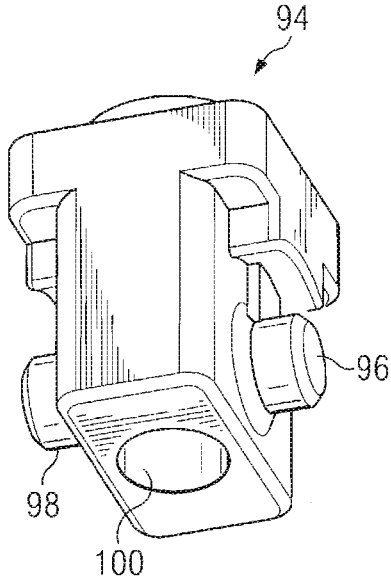
FIG. 17 is an underside perspective view of the guide post coupling block shown in FIG. 13.
Figure 18:
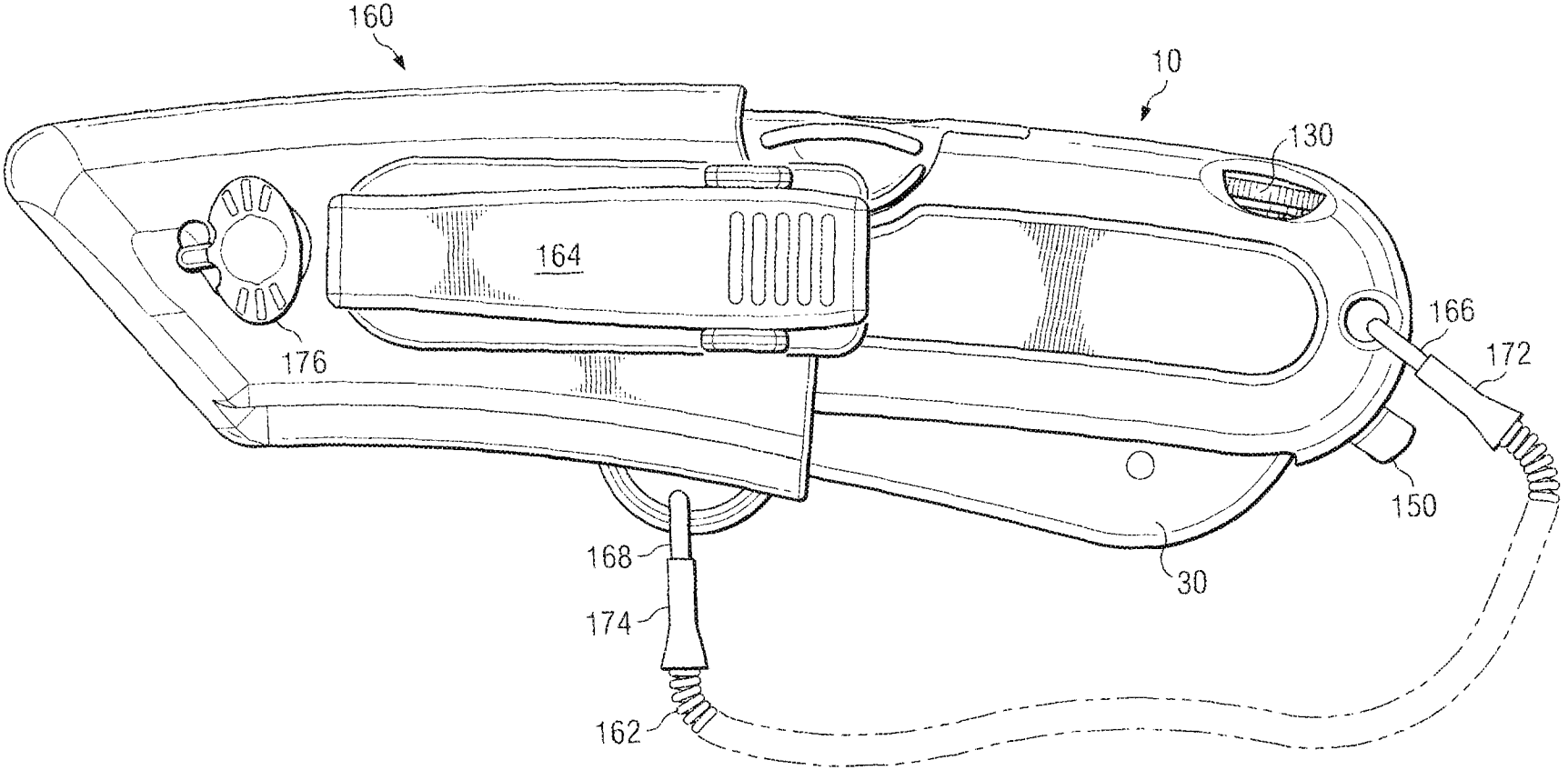
FIG. 18 is left side elevation view of the box cutter utility knife of FIG. 1 inserted into a holster, and coupled thereto by a coiled lanyard.
Figure 19:
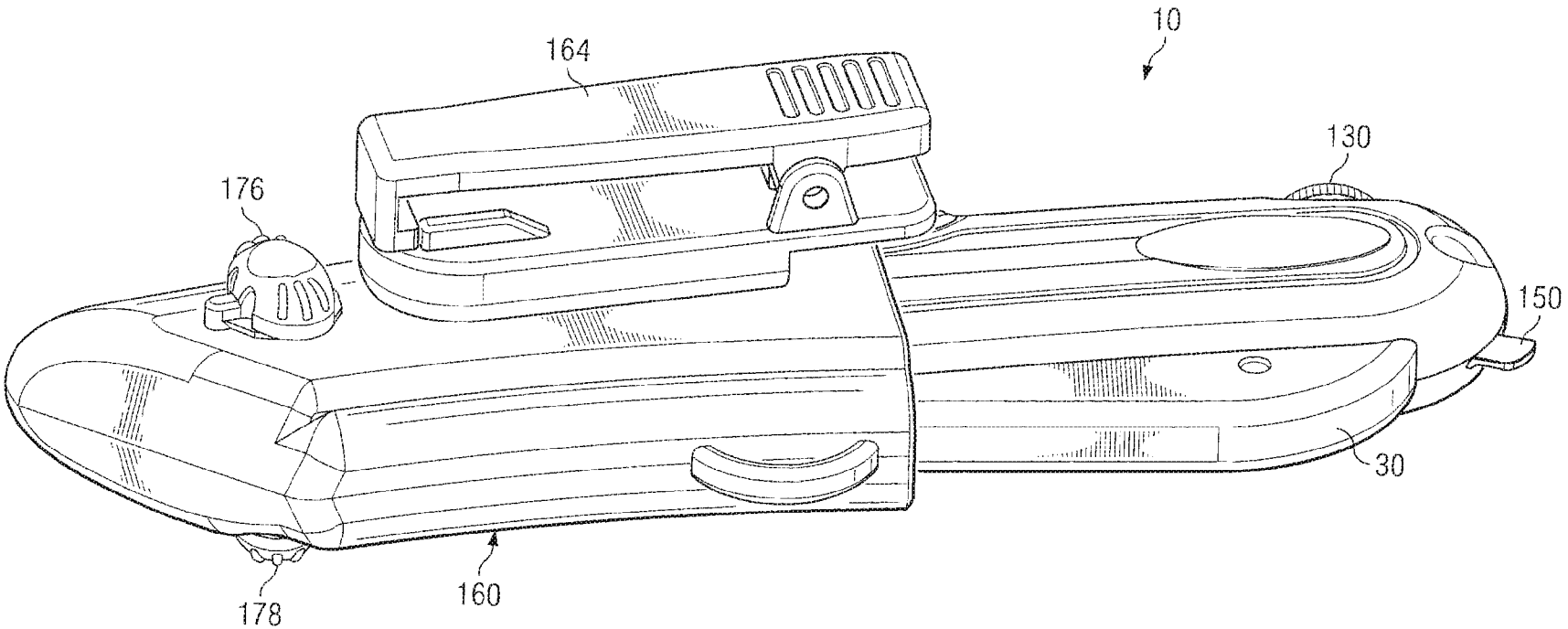
FIG. 19 is a bottom perspective view thereof.
Figure 20:
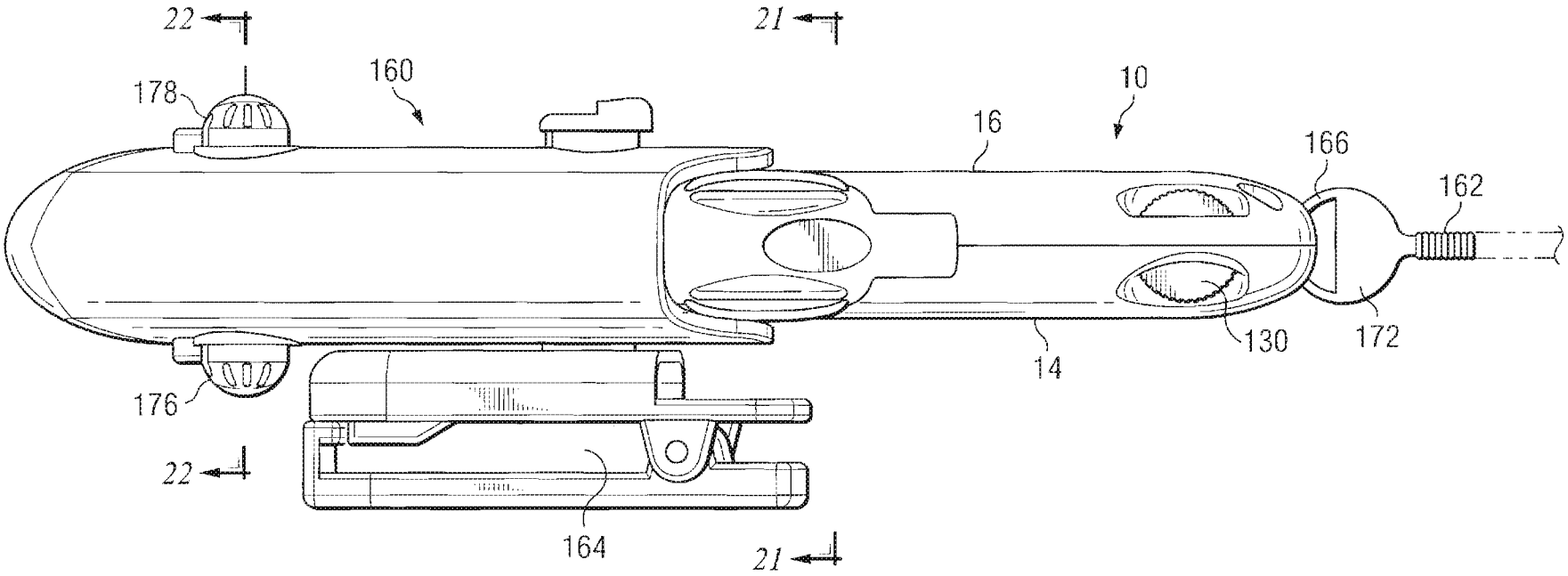
FIG. 20 is a top plan view thereof.
Figure 21:
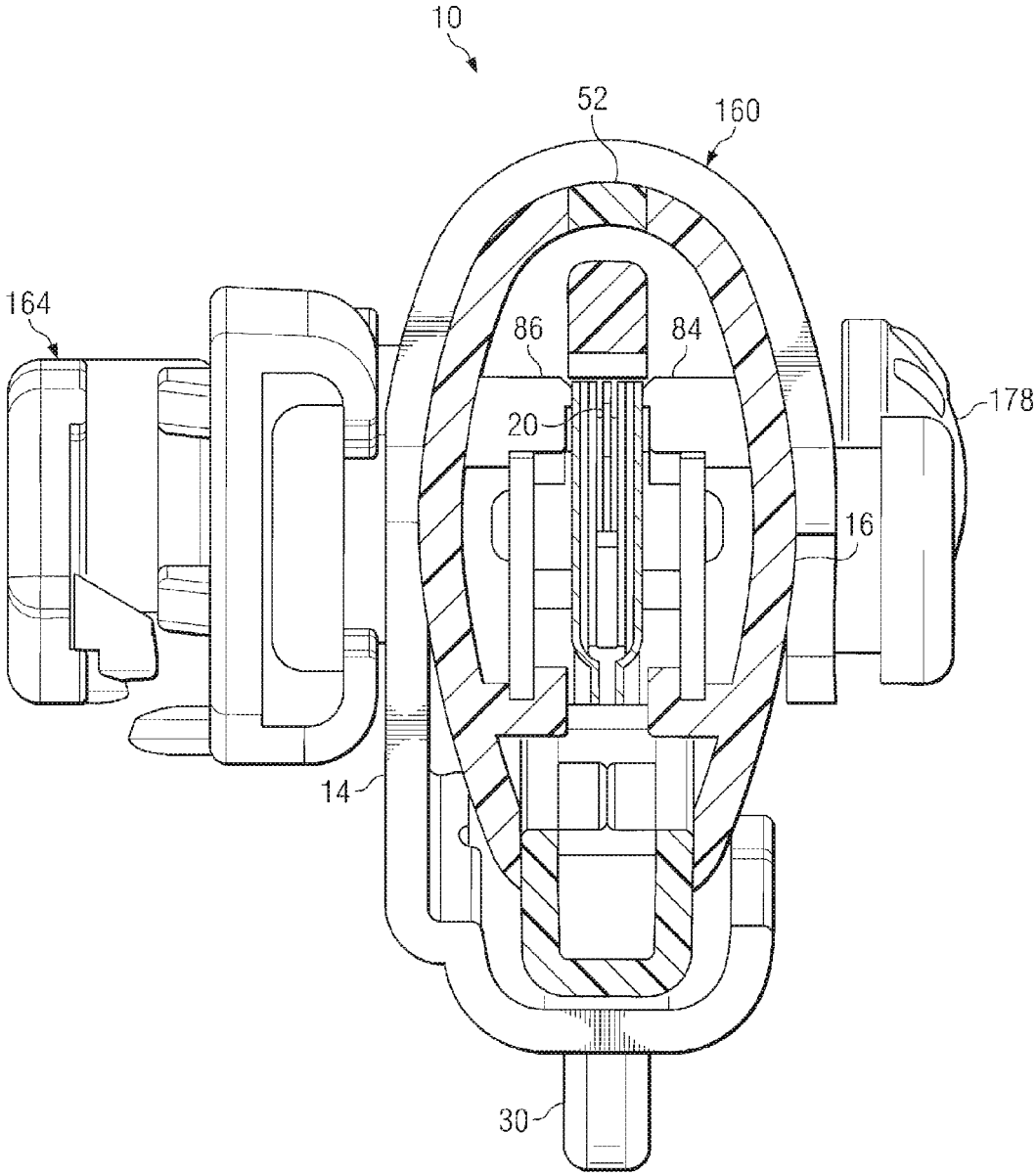
FIG. 21 is a cross sectional view thereof taken along line 21-21 of FIG. 20.
Figure 22:
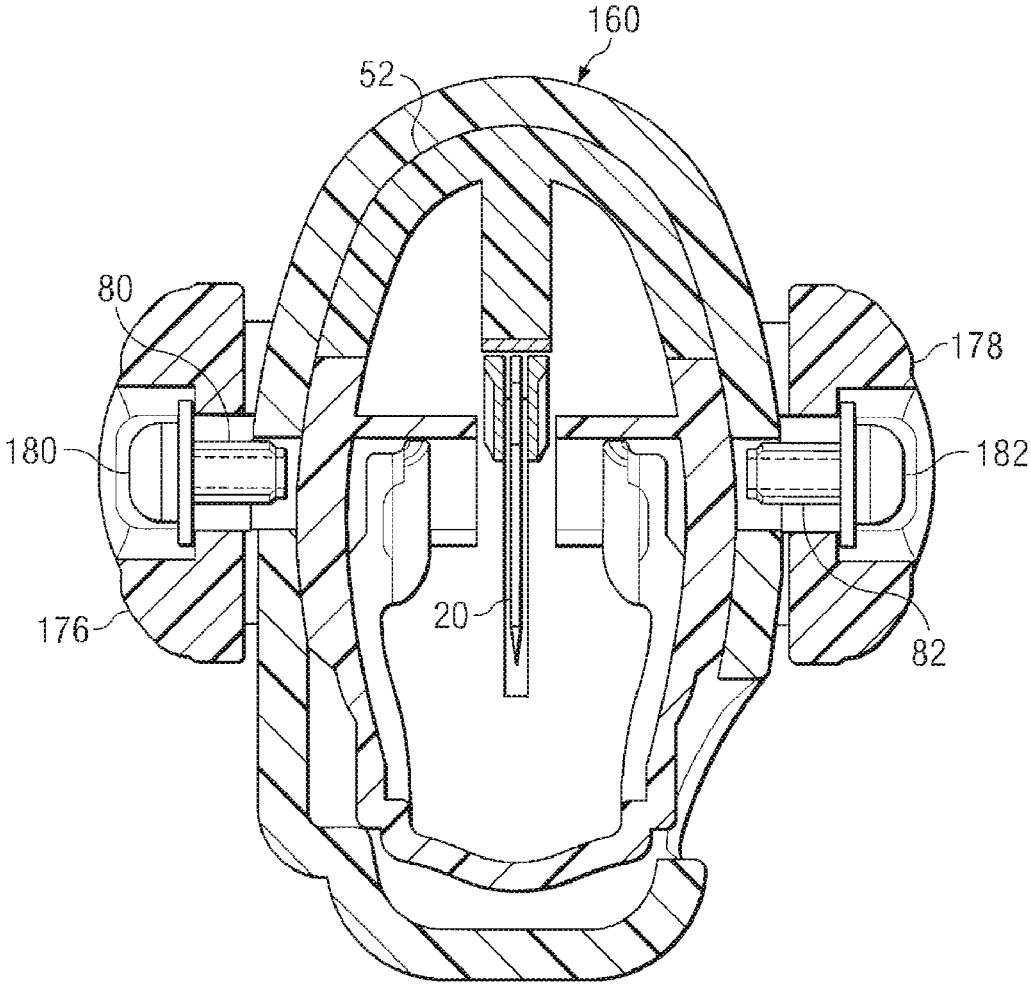
FIG. 22 is a cross sectional view thereof taken along line 22-22 of FIG. 20.

Referring to FIG. 1 and FIG. 12, the depth of cut is adjusted by moving the dial 130 to one of the four preset depth-of-cut positions: "No. 3" (blade fully extended), "No. 2" (intermediate), "No. 1" (minimum) and "L" (blade fully retracted and locked). The shuttle and blade assembly is slidably retained in the slide passage 25 formed between the handle sidewall webs and the top and bottom handle edges respectively. The working blade 20 is carried along with the shuttle, the depth of cut assembly being adjustably extendable and retractable in and out of the forward end of the handle to the preset positions by manual engagement of the index spline with one of the detent notches formed in the travel block.

The detent notches are fixed angularly spaced positions providing a fully extended detent position No. 3 corresponding to at least a segment of the blade and its cutting edge projecting beyond the front end of the handle at a maximum depth of cut (utility depth of cut for cutting sheet stock, tie wraps, floor tile), a partially extended detent position No. 2 corresponding to a shorter segment of the blade and its cutting edge projecting beyond the front end of the handle at an intermediate depth of cut (for cutting a double ply thickness corrugated box), a partially extended detent position No. 1 corresponding to a shorter segment of the blade and its cutting edge projecting beyond the front end of the handle at a minimum depth of cut (for cutting a single ply thickness corrugated box), to a fully retracted detent position "L" corresponding with the blade and its cutting edge being completely withdrawn within the handle and no portion of the cutting edge 26 is exposed, and the working blade 20 is locked in place against extension and retraction, and cannot fall out when the top panel door is closed.

A fixed stub blade 150 projects from the rear or butt end portion 50 of the handle body 12 for performing quick tape cutting jobs. The exposed cutting edges and corners of the fixed stub blade are relatively blunt for personal safety and product protection, but are sufficient for shearing a taped union, for example along the top edges of box folding panels, which are typically sealed by a strip of high strength tape.

As the knife is pulled toward the operator, the cutting edge cuts into the box sidewall, penetrating to the full extent of the projection of the blade segment beyond the handle. The blade is forced into the box sidewall until the oblique edges at the front end of the handle are pulled into contact against the box. Once the blade segment is fully inserted, the knife 10 is pulled along the box at approximately the same angle, and of course as the knife moves, its cutting edge slits the sidewall of the box. As the blade exits from the box, and the hand grip pressure on the lever is relaxed during the cutting process the compression spring 34 automatically returns the blade shuttle to the fully retracted position, thus preventing inadvertent blade contact with the operator immediately after the knife is disengaged during follow-through that accompanies rapid hand movements.

In short, the shuttle and cutter blade will immediately retract into the housing so that the blade cannot harm the operator or someone nearby. In this regard, it should be recognized that the box material exerts a considerable amount of resistance on the working blade and accordingly the knife must be pulled with a considerable amount of force. Once this resistance is released, which occurs when the blade passes beyond the edge of the box, the force, unless restrained, will propel the knife 10 in a condition of lesser control. Since the compression spring immediately returns the blade to the covered position upon disengagement of the blade from the box, the chances of cut injury are diminished substantially. Moreover, because of the ergonomic proportions of the handle, the operator can safely handle the box cutter with the same care and attention devoted to other hand tools and with confidence that an accidental cut is not likely, for example when picking up the knife and handling it in preparation for a job, putting the knife away or carrying it while it is not being used.

Referring now to FIG. 18-FIG. 22, a holster assembly 160 for the box cutter 10 provides for normal use of the box cutter in the workplace while keeping the box cutter in close proximity to the operator for ready use. The holster has a body substantially conforming to the shape of the box cutter 10, an open top end, and a closed bottom end.

A coiled lanyard 162 secures the box cutter to the holster and a belt clip 164, which is releasably engaged with the holster, attaches the holster to a belt of an operator. The lanyard is a coiled plastic cord, capable of uncoiling to a greater length when pulled, and having the ability to recover and return to its at rest, minimum length condition when released. The coiled lanyard 162 is a convenient tether to recover the knife quickly when it is dropped, so that it will not be lost and out of the possession of unauthorized users.

An expansion ring 166 connects the lanyard to the butt end of the knife, and the opposite end of the lanyard is connected to the holster 160 by another coupling ring 168. Each expansion ring is covered with a short shroud of shrink wrap tubing 170, 172. The shrouds 172, 174 discourage unauthorized removal of the lanyard, and the shroud 172 provides a shield flap that shields the operator from inadvertent contact with the stub blade 150.

Snap-fit detent couplings 176, 178 are formed on opposite sides of the holster. These detent couplings have rotary index members 180, 182 that engage index pins 87, 89 attached to the left and right edge guides 80, 82 when the knife is inserted into the holster. The detent couplings are rotatable to predetermined positions that engage the edge guides and automatically extend the edge guides to a predetermined offset extension length. Thus the operator can set the coupling to accommodate right handed or left handed operation, and can also set the holster to automatically extend the edge guide by a preset amount upon withdrawal of the knife from the holster.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

We claim:

1. A utility knife, comprising:

a handle body having sidewall portions defining a guide channel;

a blade shuttle mounted for extension and retraction movement within the guide channel and being movable between a non-use position such that a blade mounted on the blade shuttle is enclosed in the guide channel, and an extended position such that a portion of the blade projects from the guide channel;

a hand-grip lever coupled to the handle body at a fulcrum for pivotal movement between an at-rest position in which the blade shuttle is in the non-use position, to an in-use position in which the blade shuttle is in the extended position, the hand-grip lever rotatably coupled to the blade shuttle through a transmission comprising a pin coupled to the hand-grip lever such that a distance from the fulcrum to the pin stays substantially fixed as the hand-grip lever pivots between the at-rest and in-use positions;

a biasing member urging the hand-grip lever to the at rest position, the biasing member being compressible and extendable and coupled between the handle body and the hand grip-lever;

a guide post disposed between the handle body and coupled to the hand-grip lever, wherein the biasing member is disposed around the guide post and confined for compression and expansion between the handle body and the hand-grip lever in response to pivoting movement of the hand-grip lever; and a selector dial attached to the guide post, wherein the selector dial is adjustable to vary the tension on the biasing member.

2. The utility knife of claim 1, wherein at least a portion of the transmission is movably coupled between the blade shuttle and the hand-grip lever for translating rotational movement of the hand-grip lever to substantially linear movement of the blade shuttle.

3. The utility knife of claim 2, further comprising a locked position such that pivotal movement of the hand-grip lever is substantially prevented in the locked position.

4. The utility knife of claim 3, wherein the selector dial is adjustable to a plurality of discrete positions, the plurality of discrete positions comprising the locked position.

5. The utility knife of claim 4, wherein the plurality of discrete positions comprise:

a first discrete position, such that the hand-grip lever is pivotable a first radial distance from the at rest position when the dial selector is at the first discrete position;

a second discrete position, such that the hand-grip lever is pivotable a second radial distance from the at rest position different from the first radial distance when the dial selector is at the second discrete position; and a third discrete position, such that the hand-grip lever is pivotable a third radial distance from the at rest position different from the first radial distance and second radial distance when the dial selector is at the third discrete position.

6. The utility knife of claim 1, further comprising a first guide member extendable from a sidewall portion of the handle body towards an end portion of the handle body from which the blade projects when the blade shuttle is in the extended position.

7. The utility knife of claim 6, further comprising a second guide member, wherein the first and second guide members are positioned on opposed sidewall portions of the handle body.

8. The utility knife of claim 6, wherein the guide member comprises a curved ridge extending from a lateral portion of the guide member, the curved ridge operable to receive a force from a user to extend the guide member from the sidewall portion.

9. The utility knife of claim 8, wherein the guide member remains a substantially fixed distance from the blade when the blade shuttle is in the extended position during a cutting movement of the knife.

10. The utility knife of claim 1, wherein the biasing member comprises a compression spring, the compression spring comprising a first end and a second end, wherein a diameter of the compression spring at the first and second ends is less than a diameter of the compression spring at a midpoint of the spring between the first and second ends.

11. The utility knife of claim 1, wherein the hand-grip lever is sized to receive gripping engagement of at least three human fingers.

12. A utility knife, comprising:

a handle body having sidewall portions defining a guide channel;

a blade shuttle mounted for extension and retraction movement within the guide channel and being movable between a non-use position such that a blade mounted on the blade shuttle is enclosed in the guide channel and one of a plurality of discrete extended positions such that a portion of the blade projects from the guide channel when the blade shuttle is in any of the plurality of discrete extended positions;

a biasing member urging the hand-grip lever to the at-rest position, the biasing member compressible and expandable and coupled between the handle body and the hand-grip lever;

a guide post disposed between the handle body and coupled to the hand-grip lever, the biasing member disposed around the guide post and confined for compression and expansion between the handle body and the hand-grip lever in response to pivoting movement of the hand-grip lever;

a selector dial attached to the guide post, the selector dial adjustable to vary the tension on the biasing member; and a hand-grip lever coupled to the handle body at a fulcrum for pivotal movement between an at-rest position in which the blade shuttle is in the non-use position, to only one of a plurality of in-use positions in which the blade shuttle is in one of the plurality of discrete extended positions, the hand-grip lever rotatably coupled to the blade shuttle through a transmission comprising a pin coupled to the lever such that a distance from the fulcrum to the pin stays substantially fixed as the lever pivots between the at-rest and in-use positions, wherein the plurality of discrete extended positions comprise:

a first discrete extended position, such that the hand-grip lever is only pivotable to a first radial distance from the at rest position when the blade shuttle is extended to the first discrete extended position; and a second discrete extended position, such that the hand-grip lever is only pivotable to a second radial distance from the at rest position different from the first radial distance when the blade shuttle is extended to the second discrete extended position.

13. The utility knife of claim 12, wherein at least a portion of the transmission is movably coupled between the blade shuttle and the hand-grip lever for translating rotational movement of the hand-grip lever to substantially linear movement of the blade shuttle.

14. The utility knife of claim 13, further comprising a locked position such that pivotal movement of the hand-grip lever is substantially prevented in the locked position.

15. The utility knife of claim 14, wherein the selector dial is adjustable to set to one of a plurality of discrete dial positions, the plurality of discrete dial positions comprising the locked position.

16. The utility knife of claim 15, wherein the plurality of discrete dial positions comprise:

a first discrete dial position, such that the hand-grip lever is pivotable only to the first radial distance from the at rest position when the dial selector is set to the first discrete dial position; and a second discrete dial position, such that the hand-grip lever is pivotable only to the second radial distance from the at rest position different from the first radial distance when the dial selector is set to the second discrete position.

17. The utility knife of claim 16, wherein:

the first discrete position corresponds to a first setting for cutting a single ply thickness corrugated box; and the second discrete position corresponds to a second setting for cutting a double ply thickness corrugated box.

18. The utility knife of claim 15, wherein the plurality of discrete extended positions further comprise a third discrete extended position, such that the hand-grip lever is only pivotable to a third radial distance from the at rest position different from the first and second radial distances when the blade shuttle is extended to the third discrete extended position.

19. The utility knife of claim 18, wherein the plurality of discrete dial positions further comprise a third discrete position, such that the hand-grip lever is only pivotable to the third radial distance from the at rest position different from the first and second radial distances when the dial selector is set to the third discrete dial position.

20. The utility knife of claim 12, wherein the biasing member comprises a barrel spring.

21. The utility knife of claim 20, the compression spring comprising a first end and a second end, wherein a diameter of the compression spring at the first and second ends is less than a diameter of the compression spring at a midpoint of the spring between the first and second ends.

22. The utility knife of claim 12, further comprising a cavity arranged to store one or more spare blades.

23. The utility knife of claim 22, wherein the cavity is exposed by pivoting a portion of the handle body away from the sidewall portions.

24. The utility knife of claim 12, further comprising a first guide member extendable from a sidewall portion of the handle body towards an end portion of the handle body from which the blade projects when the blade shuttle is in the extended position.

25. The utility knife of claim 24, further comprising a second guide member, wherein the first and second guide members are positioned on opposed sidewall portions of the handle body.

26. The utility knife of claim 24, wherein the guide member comprises a curved ridge extending from a lateral portion of the guide member, the curved ridge operable to receive a force from a user to extend the guide member from the sidewall portion.

27. The utility knife of claim 26, wherein the guide member remains a substantially fixed distance from the blade when the blade shuttle is in the extended position during a cutting movement of the knife.

28. The utility knife of claim 12, wherein the handle body further comprises an aperture for coupling a lanyard to the handle body through the aperture.

29. The utility knife of claim 12, wherein the hand-grip lever comprises a wedge-shaped gripping profile.

30. The utility knife of claim 12, wherein the hand-grip lever is sized to receive gripping engagement of at least three human fingers.

31. The utility knife of claim 12, wherein the pin is a first pin; and the knife further comprises a second pin disposed at the fulcrum, such that a distance from the first pin to the second pin stays substantially fixed as the lever pivots between the at-rest and in-use positions.

* * * * *

UNITED STATES PATENT AND TRADEMARK OFFICE

CERTIFICATE OF CORRECTION

PATENT NO. : 8,220,160 B2
APPLICATION NO. : 11/735997
DATED : July 17, 2012
INVENTOR(S) : Raymond E. Davis and Clifton Glenn Hampton It is certified that error appears in the above-identified patent and that said Letters Patent is hereby corrected as shown below:

Column 11, Line 61, in Claim 1, delete “hand grip-lever;” and insert -- hand-grip lever; --

Signed and Sealed this
Eleventh Day of September, 2012

David J. Kappos

David J. Kappos
*Director of the United States Patent and Trademark Office*